US007931483B2

(12) United States Patent
Komiyama et al.

(10) Patent No.: US 7,931,483 B2
(45) Date of Patent: Apr. 26, 2011

(54) LEVER-TYPE CONNECTOR

(75) Inventors: Ryuichi Komiyama, Tokyo (JP); Kazushige Sakamaki, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/565,378

(22) Filed: Sep. 23, 2009

(65) Prior Publication Data

US 2010/0081313 A1 Apr. 1, 2010

Related U.S. Application Data

(63) Continuation of application No. PCT/JP2008/053840, filed on Mar. 4, 2008.

(30) Foreign Application Priority Data

Mar. 23, 2007 (JP) ..... 2007-076709

(51) Int. Cl.
*H01R 13/62* (2006.01)

(52) U.S. Cl. ..... 439/157

(58) Field of Classification Search ..... 439/157, 439/347, 595, 701, 489, 752
See application file for complete search history.

(56) References Cited

U.S. PATENT DOCUMENTS

| | | | | |
|---|---|---|---|---|
| 5,688,144 | A * | 11/1997 | Kosuge | 439/596 |
| 6,171,146 | B1 * | 1/2001 | Fink et al. | 439/595 |
| 6,305,957 | B1 * | 10/2001 | Fink et al. | 439/157 |
| 6,413,105 | B2 * | 7/2002 | Noro et al. | 439/157 |
| 2009/0246991 | A1 * | 10/2009 | Shuey | 439/157 |
| 2009/0246992 | A1 * | 10/2009 | Martin | 439/157 |
| 2009/0263997 | A1 * | 10/2009 | Tonosaki | 439/157 |
| 2009/0305536 | A1 * | 12/2009 | Martin | 439/157 |
| 2010/0178791 | A1 * | 7/2010 | Komiyama et al. | 439/347 |

FOREIGN PATENT DOCUMENTS

| | | | |
|---|---|---|---|
| JP | 2002-110295 | A | 4/2002 |
| JP | 2003-132996 | A | 5/2003 |
| JP | 2006-331991 | A | 12/2006 |

OTHER PUBLICATIONS

IPRP and Written Opinion of the International Searching Authority dated Oct. 8, 2009, for PCT/JP2008/053840 (7 pages).
International Search Report for PCT/JP2008/0563840 dated Jun. 10, 2008, 3 pages.

* cited by examiner

*Primary Examiner* — T C Patel
*Assistant Examiner* — Phuong T Nguyen
(74) *Attorney, Agent, or Firm* — Barley Snyder LLC

(57) ABSTRACT

A lever-type connector having a housing that includes a contact receiving area, a slider receiving slot, a slider, a wire cover, an outlet, a lever provided with a connector and being rotatably and detachably disposed on the housing and the cover to slide the slider; a pair of arms that extend from both ends of the connector, and a pair of wall portions arranged at the pivotal end of the arms of the lever. The wall portions extend from a pivotal end of the arms, respectively, and oppose each other at end edges of the wall portions, respectively. The outlet arranged at the wire cover has a width set greater than a width of a contact receiving area in the housing.

10 Claims, 16 Drawing Sheets

FIG. 4A
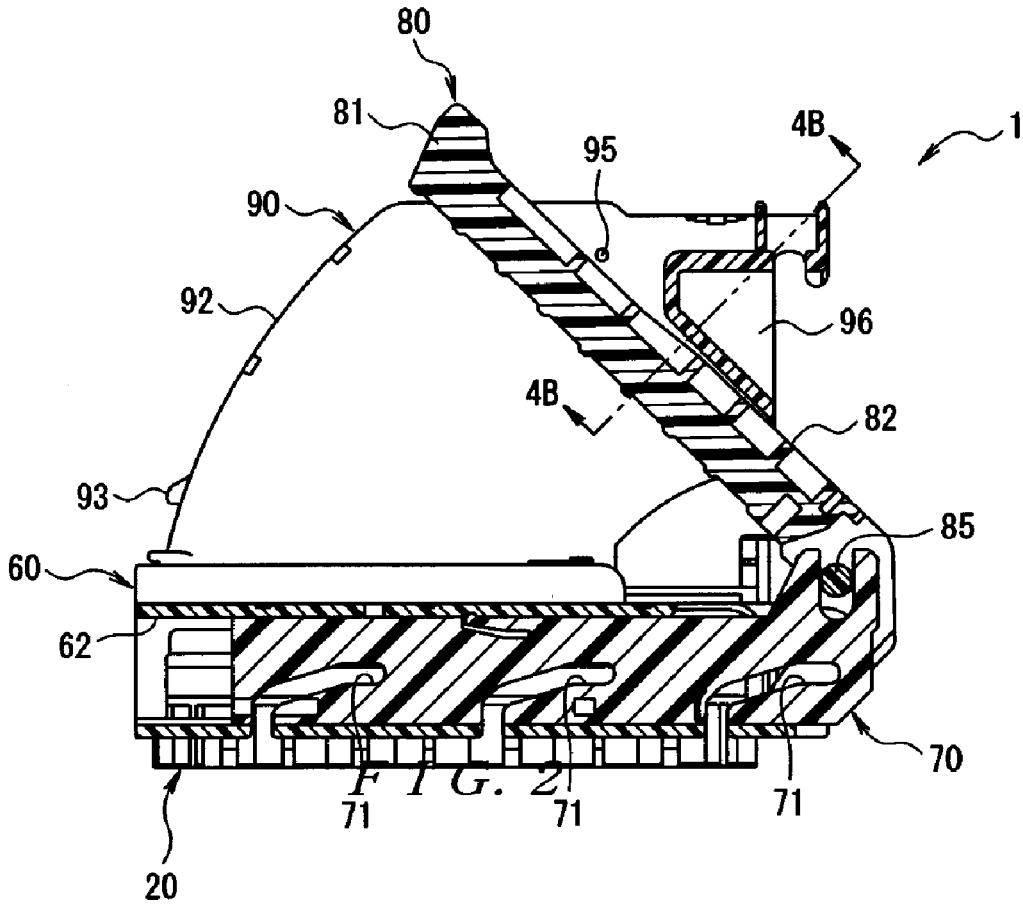
FIG. 2
FIG. 4B
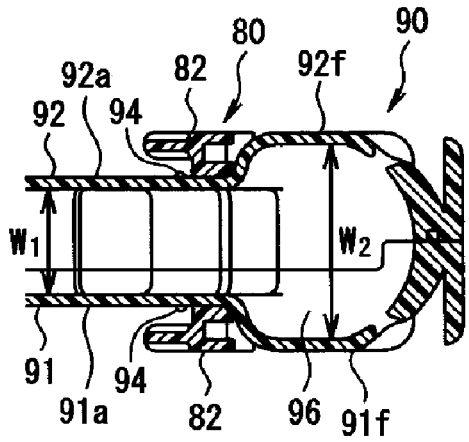

LEVER-TYPE CONNECTOR

CROSS-REFERENCE TO RELATED APPLICATIONS

This application is a continuation of PCT International Application No. PCT/JP2008/053840, filed Mar. 4, 2008, which claims priority under 35 U.S.C. §119 to Japanese Patent Application No. JP 2007-056786, filed Mar. 7, 2007.

FIELD OF INVENTION

The present invention relates to lever-type electrical connectors to reduce an operational force for mating.

BACKGROUND

When connectors having a number of contacts are mated, the mating resistance generated between mating contacts in both of the connectors becomes greater. Hence, it is generally difficult to mate the connectors by pushing the connectors by hand. For this reason, several kinds of what are called lever-type connectors, which utilize a toggle for reducing the operational force for mating, have been proposed.

As a conventional lever-type connector of such a kind, for example, the connectors shown in FIG. 13 and FIG. 14 are known. FIG. 13 is a cross-sectional view of a conventional lever-type connector. FIG. 14 is a cross-sectional view of a housing for use in the lever-type connector shown in FIG. 13.

A lever-type connector 101 shown in FIG. 13 is configured to be mated with a mating connector 150, and includes a housing 110, a pair of sliders 120, a lever 130, and a wire cover 140.

The housing 110 receives metal contacts (not shown) connected electrical wires (not shown), with the each electrical wire extracted rearward (in an upward direction in FIG. 13) from each of the contacts. In addition, the housing 110 is provided with a pair of upper and lower (in FIG. 13, the upper side denotes upper side of the paper sheet and the lower side denotes far side of the paper sheet) slider receiving slots 111 that open at both of its left and right end surfaces (in FIG. 13, the left side denotes left side and the right side denotes right side). A lever receiving groove 112 that opens at the rear surface of the housing 110 is defined in the housing 110 and at the rear side of the slider receiving slots 111.

Each of the sliders 120 are formed to have a plate shape, and is movably accommodated in the slider receiving slot 111 of the housing 110. The inner surface of each slider 120 is provided with cam grooves 121 into which cam pins 152 arranged at a mating part 151 of the mating connector 150 are inserted, as shown in FIG. 13. Also, the outer surface of each slider 120 is provided with a pin portion 122 that is inserted into an interlocking groove 133, to be described later, arranged at the lever 130.

Additionally, the lever 130 is provided to extend from a pair of arms 132 as shown in FIG. 14, each having a plate shape from both ends of an connector 131. Each arm 132 is provided with a pin opening 134, as shown in FIG. 13. The lever 130 is supported for rotation with respect to the wire cover 140 by making the pin opening 134 fit with a supporting pin 141 arranged at a substantially center in the left-and-right direction of the wire cover 140. Also, each arm 132 is provided with the interlocking groove 133 from its outer circumferential edge toward the pin opening 134. Hereinafter, for each arm 132, the side on which the connector 131 is arranged will be referred to as an end side and the side on which the pin opening 134 is arranged will be referred to as a pivotal end.

Further, the wire cover 140 is attached at the rear side of the housing 110, so as to extract the electrical wire extracted from the housing 110 at one side of the left-and-right direction (in FIG. 13, on the tight side, in FIG. 14, the near side of the paper sheet) of the housing 110.

In order to mate the lever-type connector 101 and the mating connector 150, the lever 130 and the sliders 120 are firstly located at separated positions shown in FIG. 13, so that the mating part 151 of the mating connector 150 is mated from the front side of the lever-type connector 101. Then, the cam pins 152 of the mating connector 150 enter the inlets of the cam grooves 121 arranged at the slider 120, as shown in FIG. 13, so both of the connectors 101 and 150 come to a temporary mating state. Subsequently, when the lever 130 at a separated position is rotated in the direction of arrow X in FIG. 13 to come to the mating position, the interlocking groove 133 arranged at the lever 130 pushes the pin portion 122 of the slider 120. Thus, the slider 120 interlocks with the lever 130 to move from the separated position to the mating position. The operation of the cam grooves 121 and the cam pins 152 causes both of the connectors 101 and 150 to come closer to each other and come to the mating state.

Conversely, when the lever 130 at the mating position is rotated in a direction opposite to the direction of arrow X to come to the separated position, the slider 120 interlocks with the lever 130 to move from the mating position to the separated position. The operation of the cam grooves 121 and the cam pins 152 causes both of the connectors 101 and 150 to be separated from each other.

In this manner, the lever-type connector 101 is configured for closure, having a rotatable lever 130 and a slider 120 that interlocks with the lever 130 and that has cam grooves 121. Thus, the operational force for mating can be reduced considerably.

It should be noted, however, that in order to improve the connection of the lever-type connector shown in FIG. 13, the configuration is employed in some cases such that the rotational center of the lever is shifted to one side of the ends in the left-and-right direction, and that one side of the ends in the left-and-right direction is pushed by the lever. In a case where the above configuration is employed for the lever-type connector 101, the pivotal end of the arm 132 in the lever 130 will protrude, from one side of the ends in the left-and-right direction of the housing 110, at the separated position of the lever 130, in some cases.

In such a case, if the mating connector 150 is mated obliquely from one side of the ends in the left-and-right direction of the housing 110, in other words, if the mating connector 150 is subject to so-called twisting mating, any one of a pair of the arms 132 of the lever 130 enters into the mating connector 150, because the arms 132 are arranged at a given interval in the up-and-down direction at the pivotal end thereof, as shown in FIG. 14. This will damage the mating contact provided at the mating connector 150.

In addition, in response to the need for downsizing the connectors, there is also a need for downsizing the lever-type connector 101 shown in FIG. 13. In particular, in the lever-type connector 101, there is a need for making the width (height) in the up-and-down direction of the wire cover 140 as narrow as the width (height) in the up-and-down direction of the contact accommodating area in the housing 110. As described, there is a need for making narrow the width in the up-and down direction, whereas the external diameters of multiple electrical wires extracted from the housing 110 remain large and unchanged. In this situation, if the width in the up-and-down direction of the wire cover 140 is made narrow and unchanged and the width of the outlet, arranged at the wire cover 140, from which the bundle of the electrical wires is extracted is also made narrow and unchanged, the outer diameter of the bundle of the electrical wires is greater than the width of the outlet in a case where too many electrical wires are extracted. In this case, there is a drawback of making it impossible to bundle the extracted electrical wires. In order to avoid the above drawback, the width (height) in the up-and-down direction of the outlet, for the electrical wires, arranged at the wire cover 140 may be conceivably set greater than the width (height) in the up-and-down direction of the contact accommodating area in the housing 110. However, if only the width of the outlet for the bundle of the electrical wires is made great, this will cause a drawback of making it impossible to integrally form the wire cover 140 molding.

SUMMARY

The present invention has been made to address the above drawback, and has an object of providing a lever-type connector whereby it is possible to avoid any damage at a mating contact provided at a mating connector, when the mating connector is subject to the twist mating on a pivotal end of an arm of a lever.

The lever-type connector includes a housing having a contact receiving area to receive at least one contact received in the housing. A slider receiving slot is formed along the housing so that a slider is slidably received with the slider receiving slot. A wire cover is attached to the housing, with the wire cover having an outlet and being prepared from a structure divided into two parts. A bundle of electrical wires, which connected to each contact, are extracted from the outlet. A lever is provided with a connector and being rotatably and detachably disposed on the housing and the cover to slide the slider. A pair of arms extend from both ends of the connector, with the lever being attached to the housing and the cover on a pivotal end of the arms, which includes a pair of wall portions arranged at the pivotal end of the arms of the lever. The wall portions extend from the pivotal end of the arms, respectively, and oppose each other at end edges of the wall portions, respectively. The outlet arranged at the wire cover has a width set greater than a width of the contact receiving area in the housing.

BRIEF DESCRIPTION OF THE DRAWINGS

FIG. 3A illustrates the state where a lever is located at a separated position, and FIG. 3B illustrates the state where a lever is located at a mating position;

FIG. 4A and FIG. 4B illustrate the lever-type connector of FIG. 1A and FIG. 1B, FIG. 4A is a cross-sectional view of the lever and a slider, and FIG. 4B is a cross-sectional view thereof taken along line 4B-4B of FIG. 4A;

FIG. 5A is a perspective view when viewed from the front side thereof, FIG. 5B is a back view, and FIG. 5B is an enlarged view of a part indicated by an arrow 5C;

DETAILED DESCRIPTION OF THE EMBODIMENT(S)

Figure 1A:
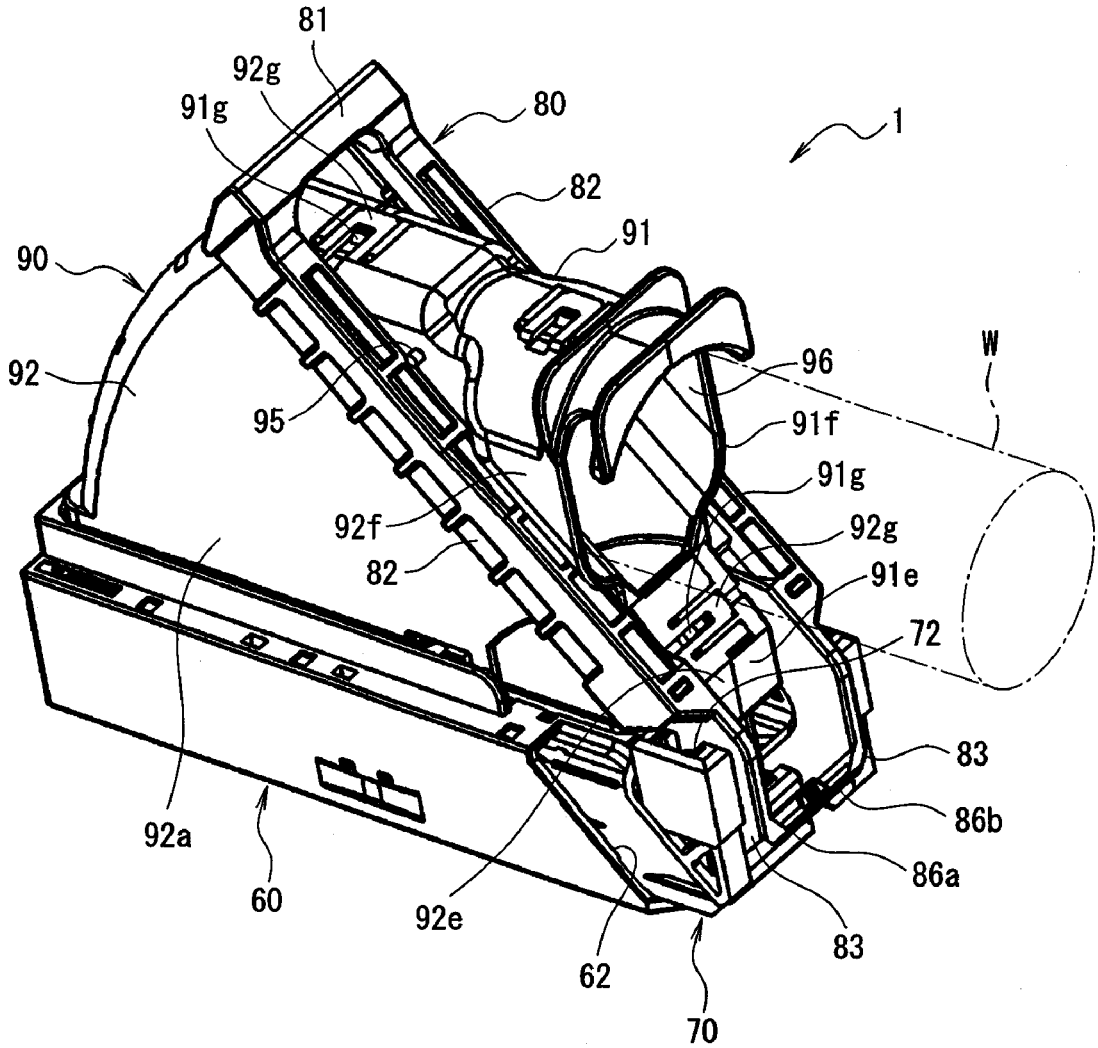
FIG. 1 is an exploded perspective view illustrative of a lever-type connector according to an aspect of the present invention.

Embodiments of the present invention will now be described with reference to the drawings.

A lever-type connector 1 illustrated in FIG. 1 includes an inner housing 10, a front cover 20, a retainer 30, a first seal 40, a second seal 50 (as a family sealing member), an outer housing 60, a pair of sliders 70, a lever 80, and a wire cover 90.

Figure 1B:
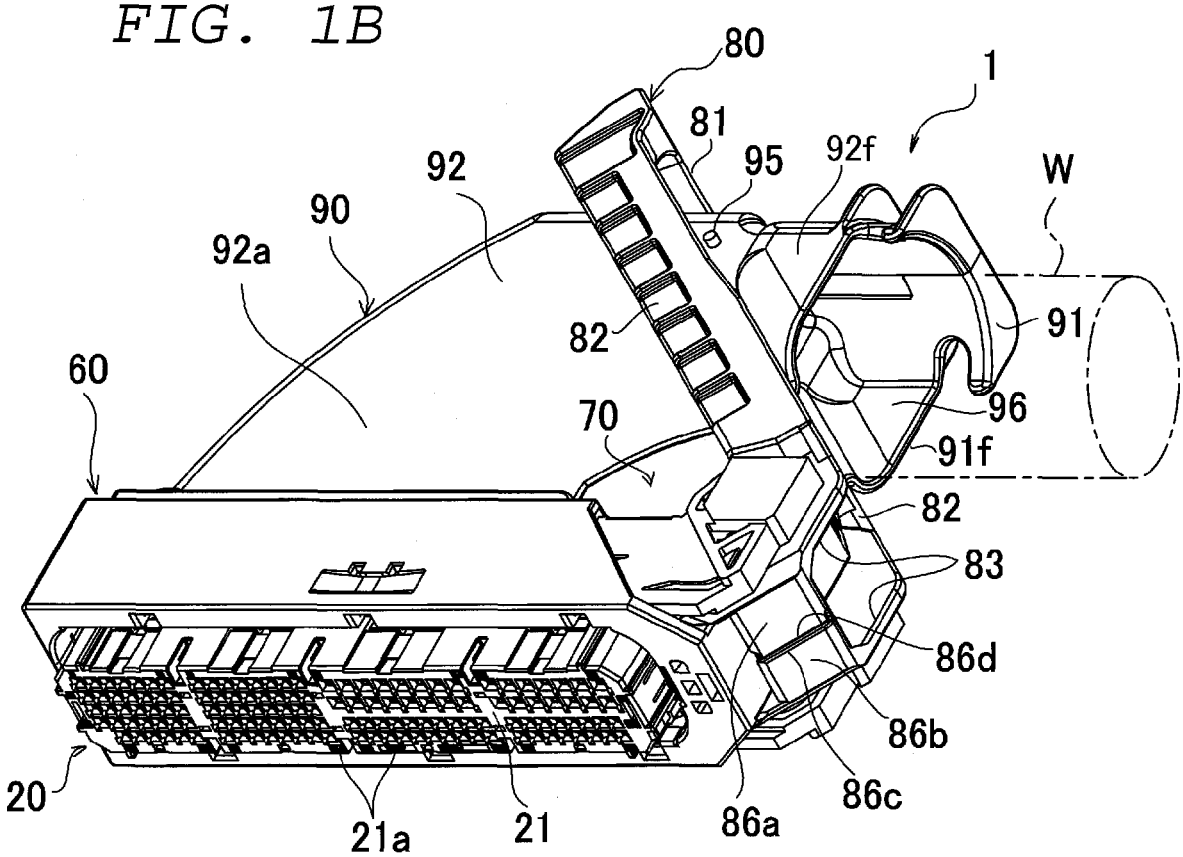
Figure 2:
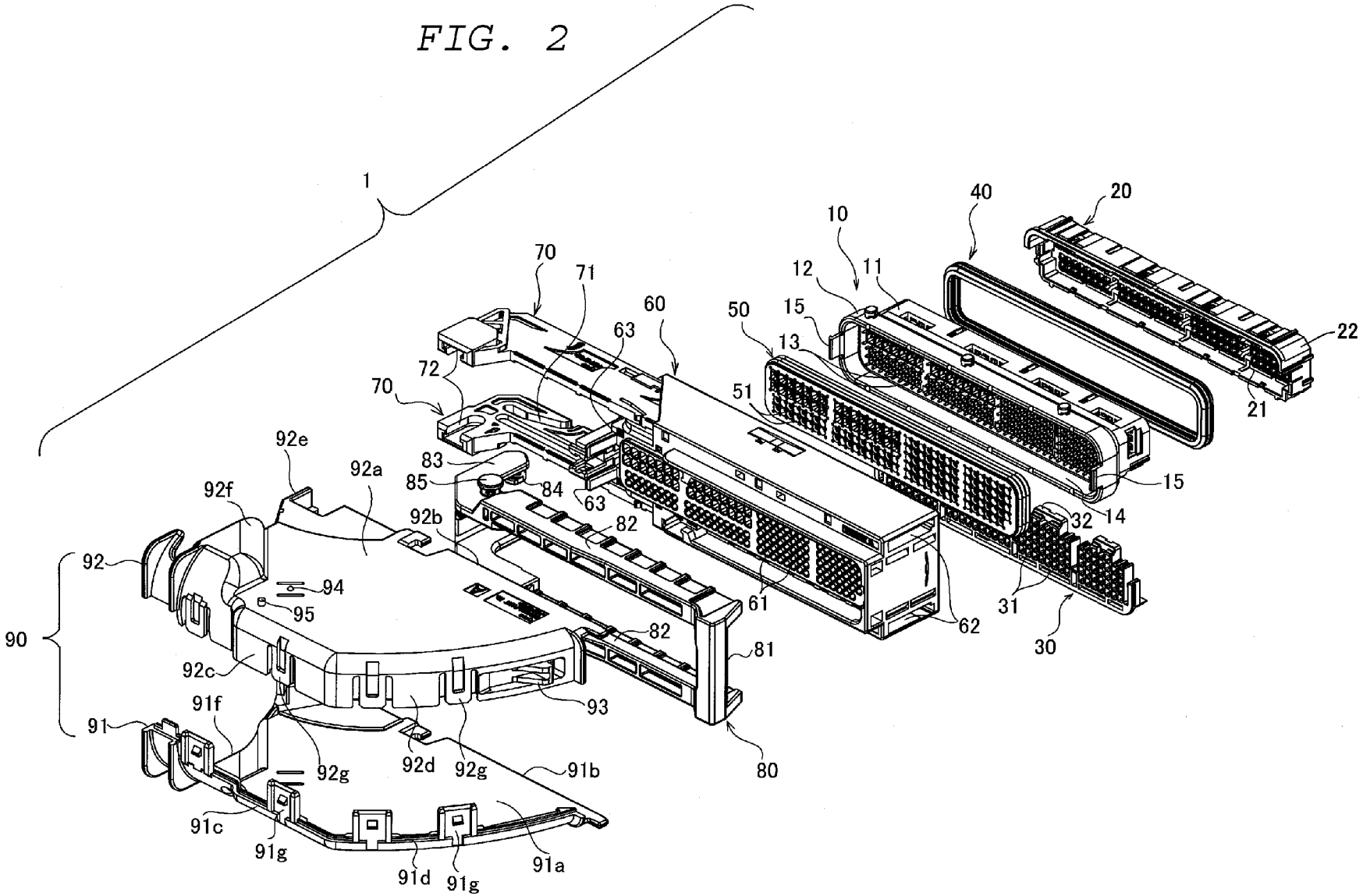
FIG. 2 illustrates an exploded perspective view of the lever-type connector illustrated in FIG. 1A and FIG. 1B.

Herein, the inner housing 10 is provided with a housing main body 11 that has a substantially rectangular parallelepiped shape and that extends in the widthwise direction (left-and-right direction in FIG. 1B), in the up-and-down direction (up-and-down direction in FIG. 1B), and in the front-and-rear direction (in a direction orthogonal to the sheet surface of FIG. 1B). Hereinafter, in FIG. 1B, the left side will be referred to as "left side", the right side will be referred to as "right side", the upper side will be referred to as "upper side", the lower side will be referred to as "lower side", the near side of the paper sheet will be referred to as "front side", and the far side of the paper sheet will be referred to as "rear side". The housing main body 11 is provided with a hood portion 12 that extend rearward from the housing main body 11, as illustrated in FIG. 2.

The housing main body 11 is provided with multiple contact receiving cavities 13 that extend therethrough in the front-and-rear direction. The inner space of the hood portion 12 defines a second seal receiving space 14. Each of the contact receiving cavities 13 is provided with a housing lance (not illustrated) that primarily latches a contact, not illustrated. A pair of housing latch arms 15 for latching the outer housing 60 with the inner housing 10 are provided to protrude rearward, at both of the ends in the widthwise direction of the hood portion 12 of the inner housing 10, as illustrated in FIG. 2.

In addition, the front cover 20 is configured to be attached to the front side of the inner housing 10. As illustrated in FIG. 2, the front cover 20 is provided with a cover main body 21 that extends in the widthwise direction and covers the front surface of the housing main body 11. The cover main body 21 is provided with multiple mating contact insertion openings 21 a into which mating contacts (not illustrated) arranged at a mating connector 401 (see FIG. 6A to FIG. 12) are inserted. Then, a hood 22 is arranged at the rear surface of the cover main body 21 so as to cover the upper surface and both of side surfaces in the widthwise direction of the housing main body 11.

Next, the retainer 30 is attached in a retainer receiving depression (not illustrated) arranged at the inner housing 10, from the lower side of the inner housing 10. As illustrated in FIG. 2, the retainer 30 has multiple contact insertion openings 31 arranged to correspond to the contact receiving cavities 13, respectively, arranged at the housing main body 11. The retainer 30 is temporarily retained by the inner housing 10 at a temporary locking position where the contacts are capable of inserting into the contact receiving cavities 13 through the contact insertion openings 31, respectively, and is further pushed and secured by the inner housing 10 at a proper locking position. Then, the contacts are secondarily locked by the retainer 30.

The first seal 40 is formed to have a ring shape to tightly adhered to the outside of the housing main body 11 of the inner housing 10, as illustrated in FIG. 2. The first seal 40 seals between the housing main body 11 and the mating connector 401, and has a function of preventing water from entering into the inner housing 10 from the mating part, when the lever-type connector 1 is mated with the mating connector 401.

The second seal 50 is what is called a family sealing member. The second seal 50 is formed to have a substantially plate shape and is accommodated in a second seal receiving space 14 of the hood portion 12 in the inner housing 10 so as to tightly adhere with the inner circumferential surface of the hood portion 12, as illustrated in FIG. 2. The second seal 50 is provided with multiple electrical wire insertion openings 51 at positions corresponding to the contact receiving cavities 13, respectively. The electrical wires connected to the contacts received in the contact receiving cavities 13 are extracted rearward through the electrical wire insertion openings 51. The sealed part of the inner circumference of the electrical wire insertion opening 51 tightly adheres to the outer circumferential surface of the electrical wire, so as to prevent water from entering into the inner housing 10 from the electrical wire insertion opening 51.

Figure 5A:
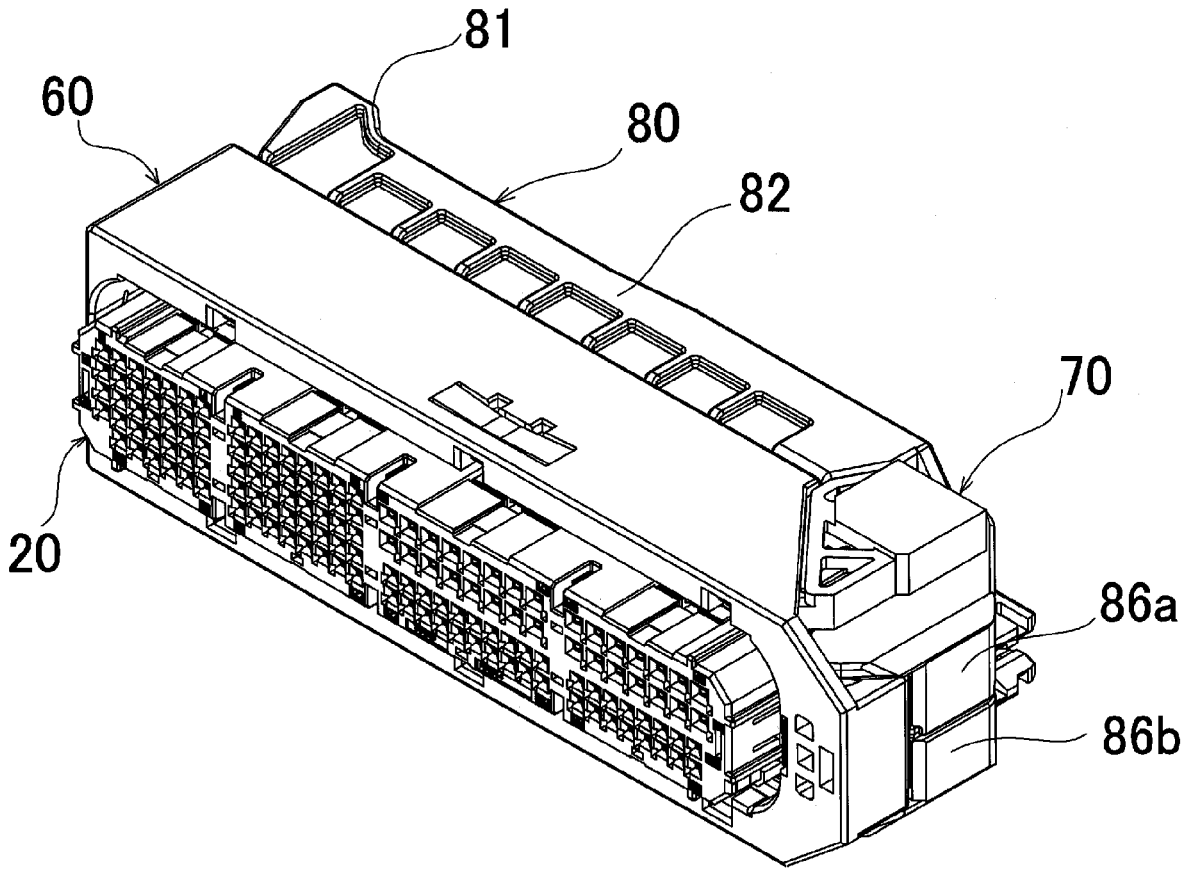
FIG. 5A to FIG. 5C illustrate the state where a wire cover is removed from the lever-type connector illustrated in FIG. 1A and FIG. 1B.
Figure 5B:
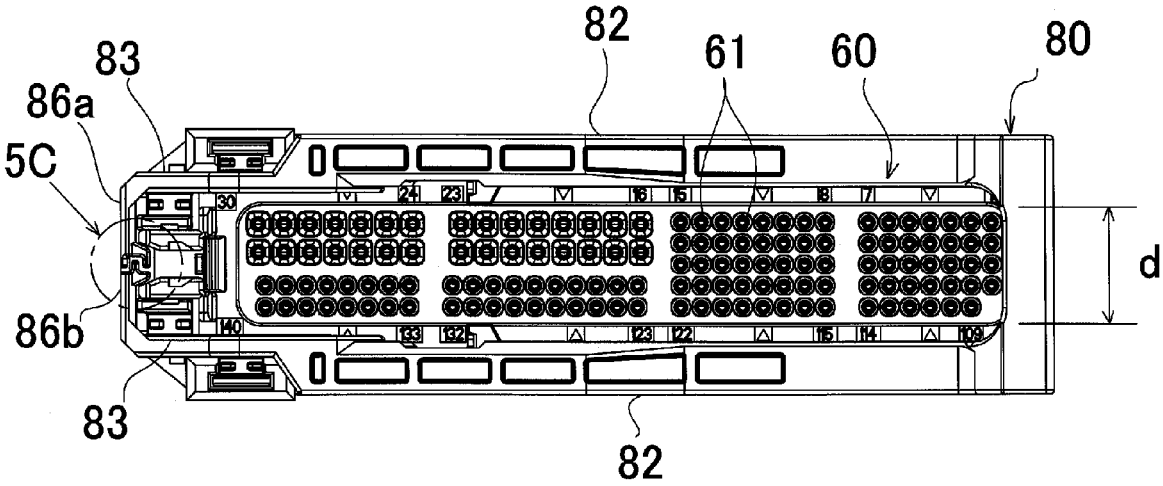
Figure 5C:
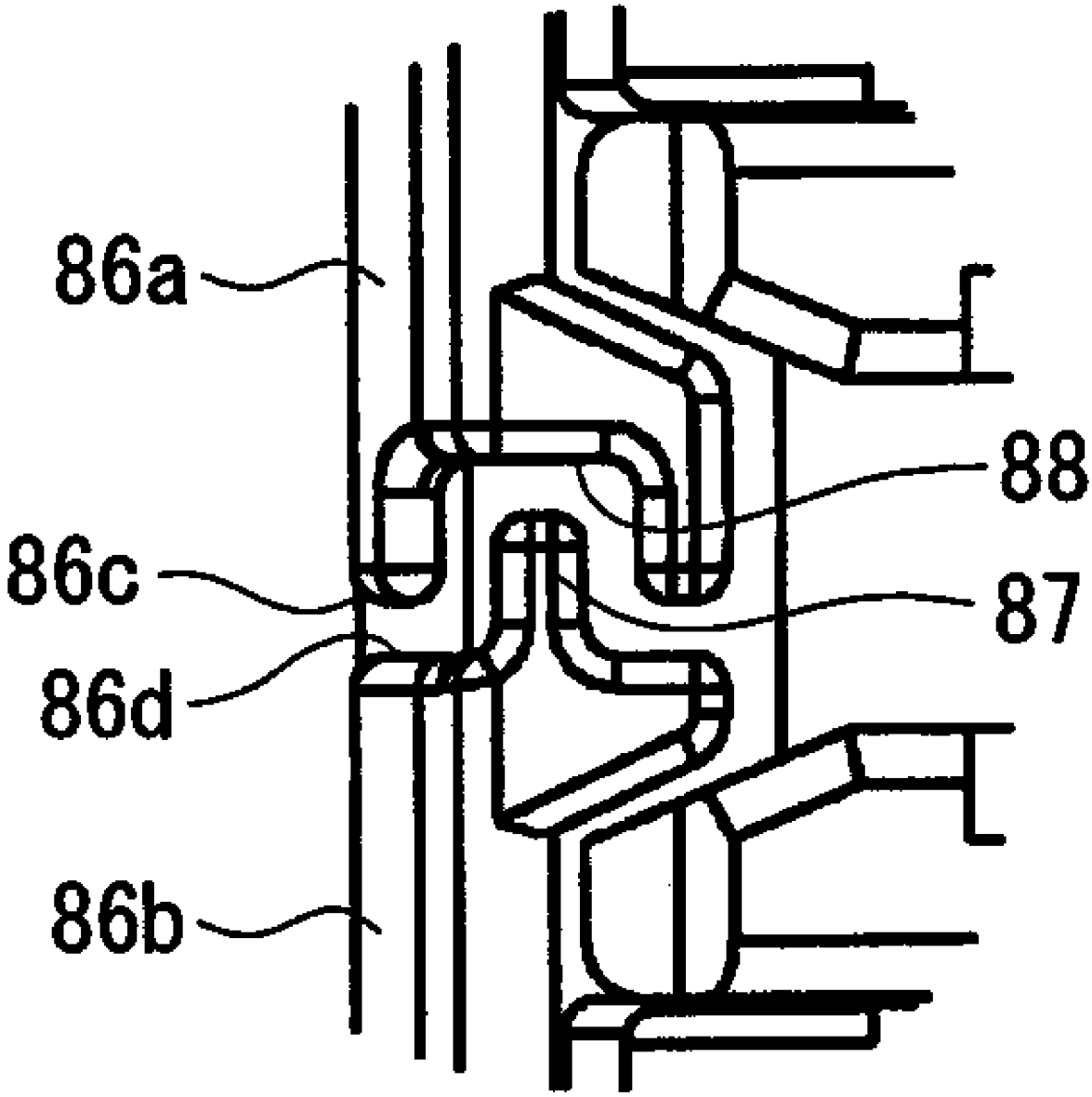

Furthermore, the outer housing 60 is attached to the rear side of the inner housing 10 to prevent the second seal 50 from dropping off. The outer housing 60 is formed to have a substantially rectangular parallelepiped shape that extends in the widthwise direction, in the front-and-rear direction, and in the up-and-down direction, as illustrated in FIG. 2. The outer housing 60 is provided with multiple electrical wire extracting openings 61 at positions respectively corresponding to the contact receiving cavities 13, as illustrated in FIG. 2. Referring to FIG. 5B, "d" indicates the width (height) in the upper-and lower direction of the area where the electrical wire extracting openings 61 are arranged, in other words, "d" indicates the width (height) in the upper-and lower direction of the contact accommodating area in the outer housing 60. Also, the outer housing 60 is provided with a pair of slider receiving slots 62 that extend in the widthwise direction, at both of its upper and lower parts. Moreover, a pivot receiving portion 63 into which a pivot 84, to be described later, of the lever 80 is fit is provided at the right end portion in the widthwise direction of the outer housing 60, as illustrated in FIG. 2.

Each slider 70 is formed to have a substantially plate shape, and is slidably accommodated in the slider receiving slot 62 of the outer housing 60. The inner surface of each of the sliders 70 is provided with cam grooves 71 into which cam pins 411 (see FIG. 6A and FIG. 6B) arranged at the mating connector 401 enter, respectively. In addition, the right end portion of the inner surface of each of the sliders 70 is provided with a slider depression 72 into which a projection for slider movement 85, to be described later, arranged at the lever 80 is inserted.

The lever 80 is integrally formed by molding an insulating resin, and is provided with a connector 81 and a pair of arms 82 that extend from both ends of the connector 81, as illustrated in FIG. 1A, FIG. 1B, and FIG. 2. An extension 83 that extends at right angle with respect to the arms 82 is arranged at an end portion on the pivotal end (an end portion opposite to the side where the connector 81 is provided) of each arm 82, and the pivot 84 is formed to project at the inner surface of the end of each extension 83. The pair of the extensions 83 are respectively provided with a pair of walls 86*a* and 86*b* that extend from the right edges of the extensions 83 to be orthogonal to each other and that oppose to each other at end edges 86*c* and 86*d*, as illustrated in FIG. 1B. Each of the pair of walls 86*a* and 86*b* is, as illustrated in FIG. 1B, formed to have a rectangular shape. The end edge 86*d* of the wall portion 86*b*, which is one of the pair of walls 86*a* and 86*b*, is provided with a projected portion 87 that protrudes toward the other wall portion 86*a*, whereas the end edge 86*c* of the wall portion 86*a*, which is the other of the pair of walls 86*a* and 86*b*, is provided with a groove 88 into which the projected portion 87 enters. The projected portion 87 is arranged at the entire length of the end edge 86*d* of the wall portion 86*b*, whereas the groove 88 is arranged at the entire length of the end edge 86*c* of the wall portion 86*a*. Further, the projection for slider movement 85 to be inserted into the slider depression 72 of each slider 70 is formed to project at the outer surface of the end portion on the pivotal end of each arm 82, as illustrated in FIG. 2.

Figure 3A:
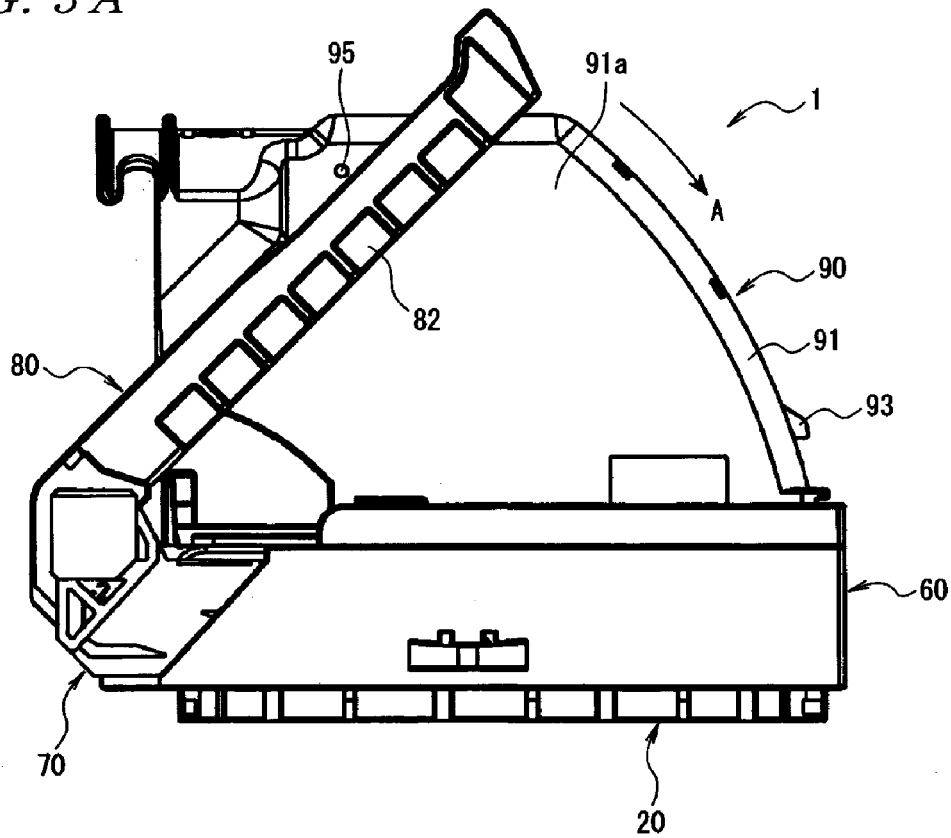
FIG. 3A and FIG. 3B illustrates the lever-type connector illustrated in FIG. 1A and FIG. 1B.
Figure 3B:
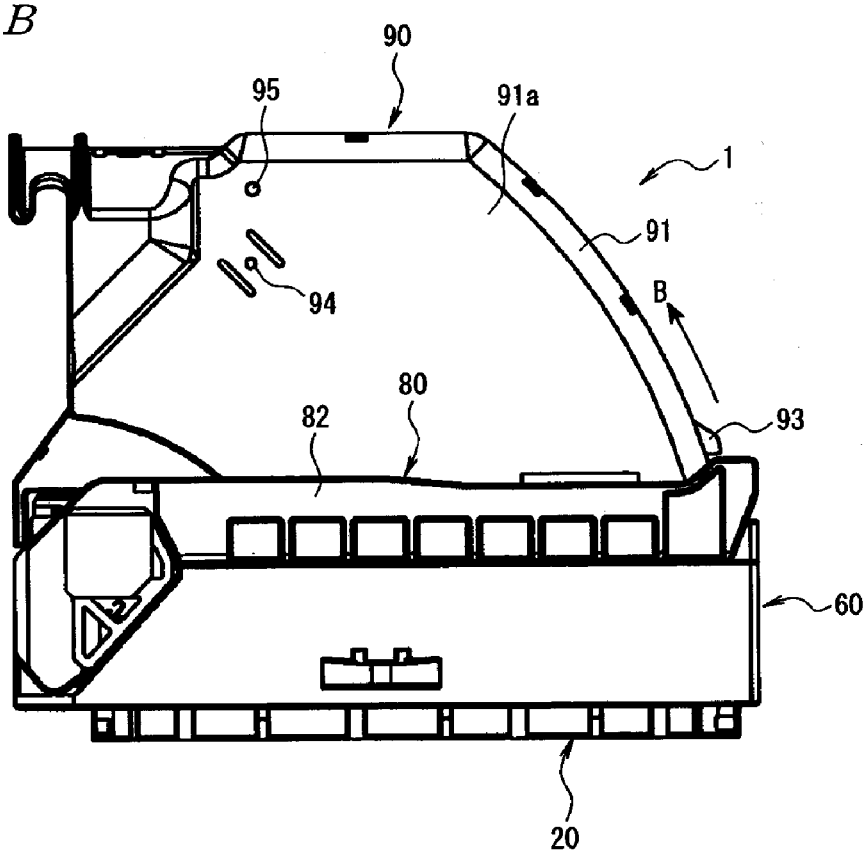

The pivot 84 of the lever 80 is fit into a pivot receiving portion 63 arranged at the right end in the widthwise direction of the outer housing 60, so as to rotate in both of the direction of arrow A, as illustrated in FIG. 3A, and the direction of arrow B, as illustrated in FIG. 3B, with respect to the outer housing 60. The lever 80 can be removed from the outer housing 60 by bending the arm 82 outward and then removing the pivot 84 from the pivot receiving portion 63. In this process, when the lever 80 is rotated from the separated position, as illustrated in FIG. 3A to the mating position illustrated in FIG. 3B in the direction of arrow A, the slider 70 interlocks with the lever 80 and slides in the left direction. The operation of cam grooves 71 and the cam pins 411 causes the lever-type connector 1 and the mating connector 401 to come closer to each other and come to the mating state.

Conversely, when the lever 80 is rotated from the mating position to the separated position in the direction of arrow B, the slider 70 interlocks with the lever 80 to slide in the right direction. The operation of the cam grooves 71 and the cam pins 411 causes the lever-type connector 1 and the mating connector 401 to be separated from each other. Such mating and separating operations will be described later in more detail.

Moreover, the wire cover 90 has a structure divided into two parts including a lower side cover 91 and an upper side cover 92 that is attached at the lower side cover 91, as illustrated in FIG. 1A, FIG. 1B, and FIG. 2. The lower side cover 91 and an upper side cover 92 are formed by molding an insulating resin, respectively.

In this situation, the lower side cover 91 is provided with a lower side plane plate 91*a*, a lower side rear wall 91*c* that rises up from the rear edge that extends in substantially parallel to a lower side front edge 91*b* of the lower side plane plate 91*a*, a lower side circular left wall 91*d* that rises up from a circular left edge portion of the lower side plane plate 91*a*, a lower side right wall 91*e* that rises up form a right edge of the lower side plane plate 91*a* (see FIG. 1A), and a lower side flared portion 91*f* that is arranged at the posterior portion of the right edge of the lower side plane plate 91*a* and that swells downward, as illustrated in FIG. 2. Multiple lower side latches 91*g* are provided at the lower side circular left wall 91*d* and the lower side right wall 91*e* of the lower side cover 91, as illustrated in FIG. 1A, FIG. 1B, and FIG. 2. Meanwhile, the upper side cover 92 is provided with, a upper side plane plate 92*a;* a upper side rear wall portion 92*c* that extends downward from the rear edge that extends in substantially parallel to a upper side front edge 92*b* of the upper side plane plate 92*a*, a upper side circular left wall 92*d* that rises up from a circular left edge portion of the upper side plane plate 92*a*, a upper side right wall portion 92*e* that rises up form a right edge of the upper side plane plate 92*a*, and a upper side flared portion 92*f* that is arranged at the posterior portion of the right edge of the upper side plane plate 92*a* and that swells upward, as illustrated in FIG. 2. Upper side multiple latches 92*g,* to be latched with the lower side latches 91*g* of the lower side cover 91, respectively as illustrated in FIG. 1A and FIG. 2, are arranged at the upper side rear wall portion 92*c*, the upper side circular left wall 92*d*, and upper side right wall portion 92*e* of the upper side cover 92. The upper side rear wall portion 92*c* and the upper side circular left wall 92*d* of the upper side cover 92 are made wider than the lower side rear wall 91*c* and the lower side circular left wall 91*d* of the lower side cover 91, respectively, so that the upper side cover 92 and the lower side cover 91 do not have a symmetrical structure.

The lower side plane plate 91*a* of the lower side cover 91 and the upper side plane plate 92*a* of the upper side cover 92 is provided with a first regulating projection 94 that regulates the rotation in the direction of arrow A from the separated position of the lever 80, as illustrated in FIG. 2, FIG. 3B, and FIG. 4B. Also, the lower side plane plate 91*a* of the lower side cover 91 and the upper side plane plate 92*a* of the upper side cover 92 is provided with a second regulating projection 95 that regulates the rotation in the direction opposite to the direction of arrow A from the separated position of the lever 80, as illustrated in FIG. 2, FIG. 3A, and FIG. 4A. Furthermore, the upper side circular left wall 92*d* of the upper side cover 92 is provided with a lock 93 that prevents the rotation in the direction of arrow B, when the lever 80 rotates in the direction of arrow A and is located at the mating position, as illustrated in FIG. 2 and FIG. 3B.

The wire cover 90 is completed by locking each of the lower side latches 91*g* of the lower side cover 91 with the upper side multiple latches 92*g* of the upper side cover 92. Then, the wire cover 90 is attached to the rear side of the outer housing 60, so that a bundle W of multiple electrical wires extracted from the electrical wire extracting openings 61 of the outer housing 60 is extracted from an outlet 96 arranged between the lower side flared portion 91*f* of the lower side cover 91 and the upper side flared portion 92*f* of the upper side cover 92, as illustrated in FIG. 1.

In this situation, "W1" is the width (height) in the upper-and lower direction between the lower side plane plate 91*a* of the lower side cover 91 and the upper side plane plate 92*a* of the upper side cover 92, as illustrated in FIG. 4B, such that the width W1 in the upper-and lower direction is substantially identical to the width (height) d in the upper-and lower direction of the contact accommodating area in the outer housing 60. Meanwhile, "W2" is the width (height) in the upper-and lower direction of the outlet 96 in the wire cover 90, as illustrated in FIG. 4B, such that the width W2 in the upper-and lower direction is greater than the width W1, in the upper-and lower direction, between the lower side plane plate 91*a* of the lower side cover 91 and the upper side plane plate 92*a* of the upper side cover 92. Accordingly, the width W2 in the upper-and lower direction is greater than the width (height) d in the upper-and lower direction of the contact accommodating area in the outer housing 60.

The mating and separating operations of the lever-type connector 1 and the mating connector 401 will now be described with reference to FIG. 4A and FIG. 4B, FIG. 6A to FIG. 9B.

Figure 6A:
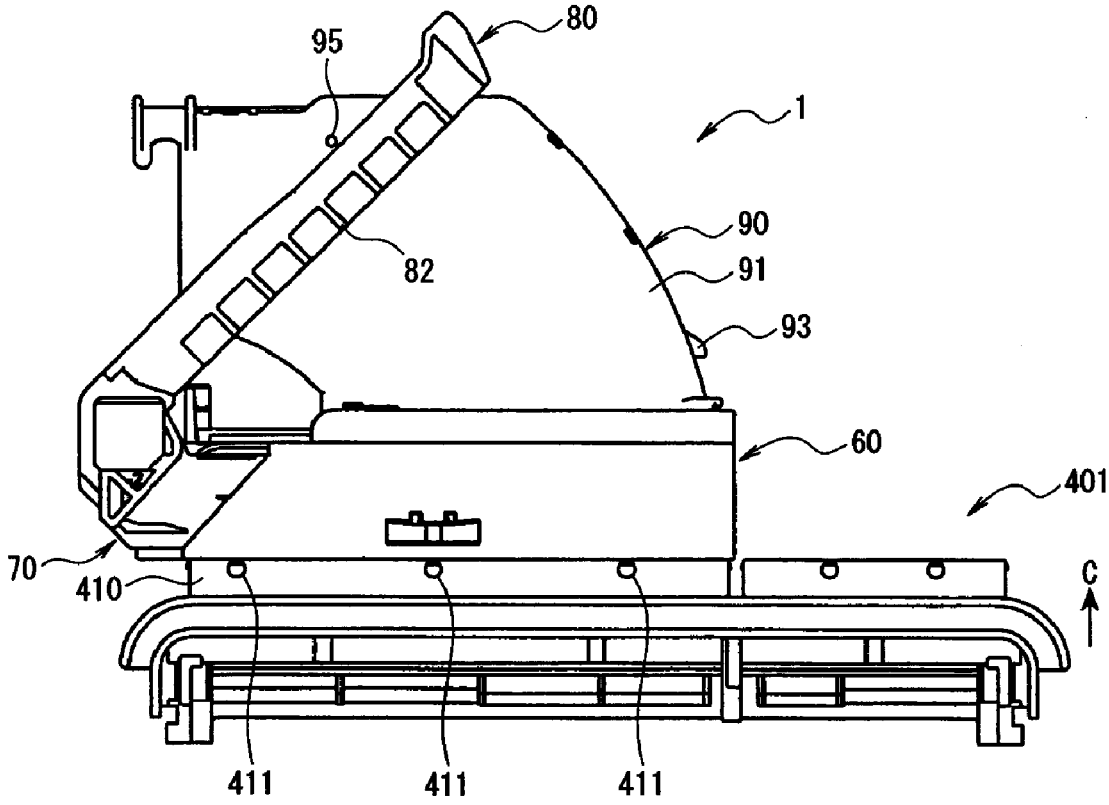
FIG. 6A and FIG. 6B are explanatory views illustrative of a state before the lever-type connector and the mating connector are mated.
Figure 6B:
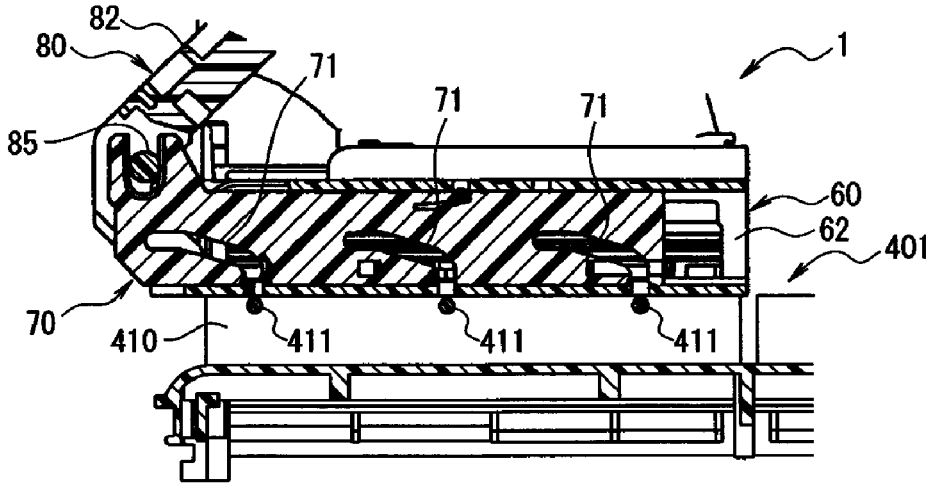
Figure 7A:
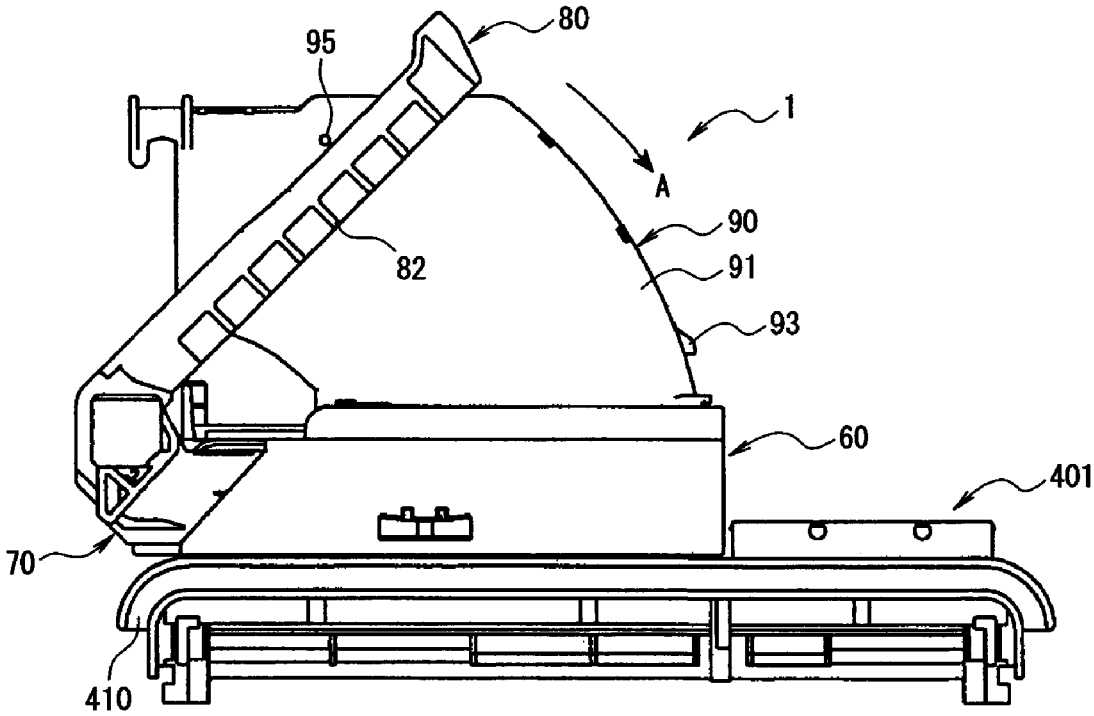
FIG. 7A and FIG. 7B are explanatory views illustrative of a mating state where the lever-type connector and the mating connector are mated.
Figure 7B:
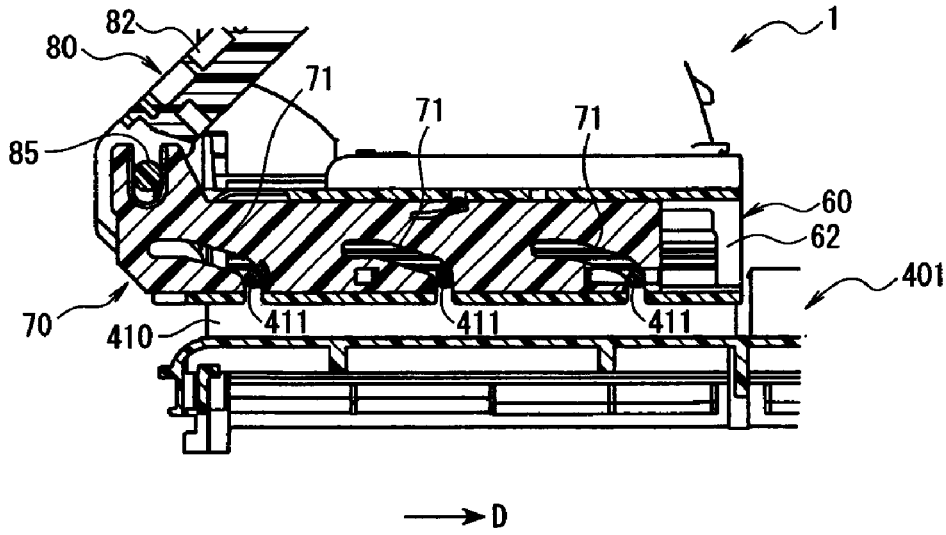

In order to mate the lever-type connector 1 and the mating connector 401, the lever 80 and the slider 70 are firstly located at separated positions illustrated in FIG. 4A and FIG. 4B and FIG. 6A and FIG. 6B. In this situation, the rotation of the lever 80 in the direction of arrow A illustrated in FIG. 7A and FIG. 7B is regulated by the first regulating projection 94 arranged at the lower side cover 91 and the upper side cover 92. Then, in this state, the mating connector 401 is pushed in the direction of arrow C from the front side of the lever-type connector 1 as illustrated in FIG. 6A and FIG. 6B. Subsequently, the cam pins 411 arranged at a housing 410 in the mating connector 401 enter inlets 71*a* of the cam grooves 71 arranged at the sliders 70, respectively, leading to the temporary mating state where the lever-type connector 1 and the mating connector 401 are mated with each other, as illustrated in FIG. 7A and FIG. 7B.

Figure 8A:
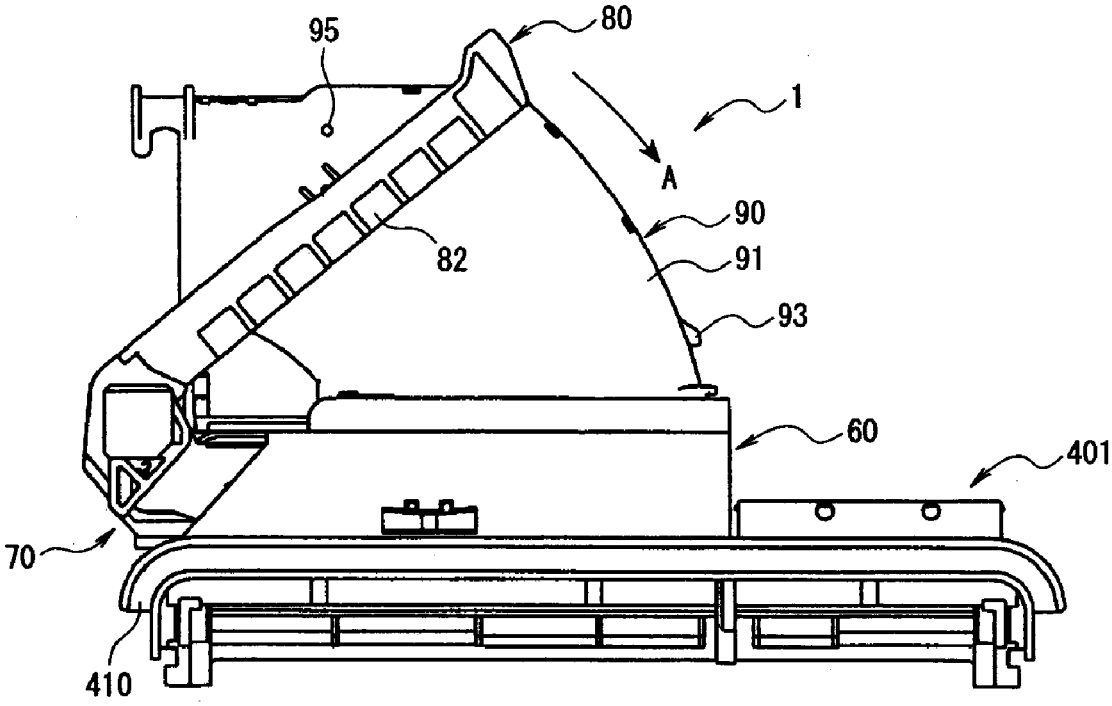
FIG. 8A and FIG. 8B are explanatory views illustrative of a state where the lever-type connector and the mating connector are on the way of being mated.
Figure 8B:
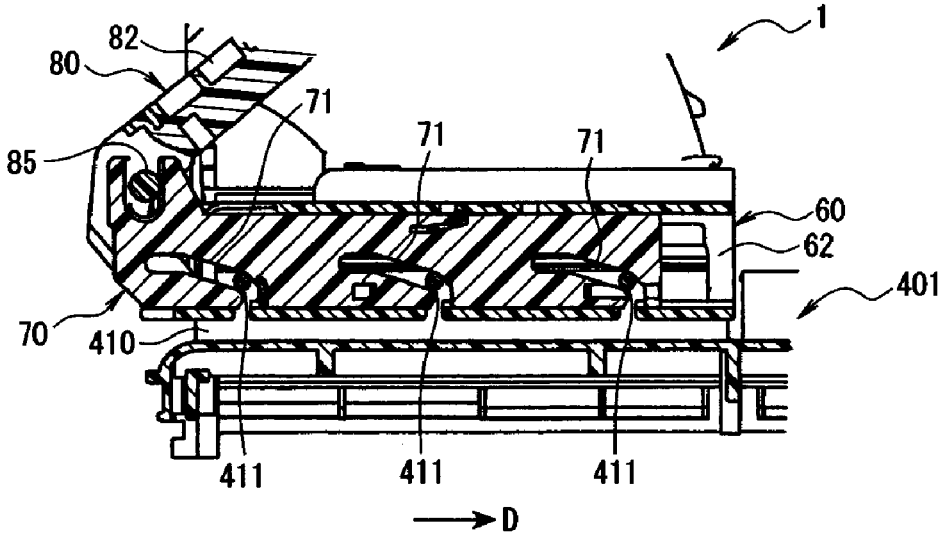

Then, when the lever 80 at the separated position is rotated in the direction of arrow A with a power greater than that necessary for releasing the regulation of the first regulating projection 94, the slider 70 interlocks with the lever 80 in the direction of arrow D, namely the sliders 70 further slide in the left direction. This achieves the mating completed state as illustrated in FIG. 8A and FIG. 8B. In this case, the operation of the cam grooves 71 arranged at the slider 70 and the cam pins 411 arranged at the mating connector 401 causes the lever-type connector 1 and the mating connector 401 to get closer to each other slightly.

Figure 9A:
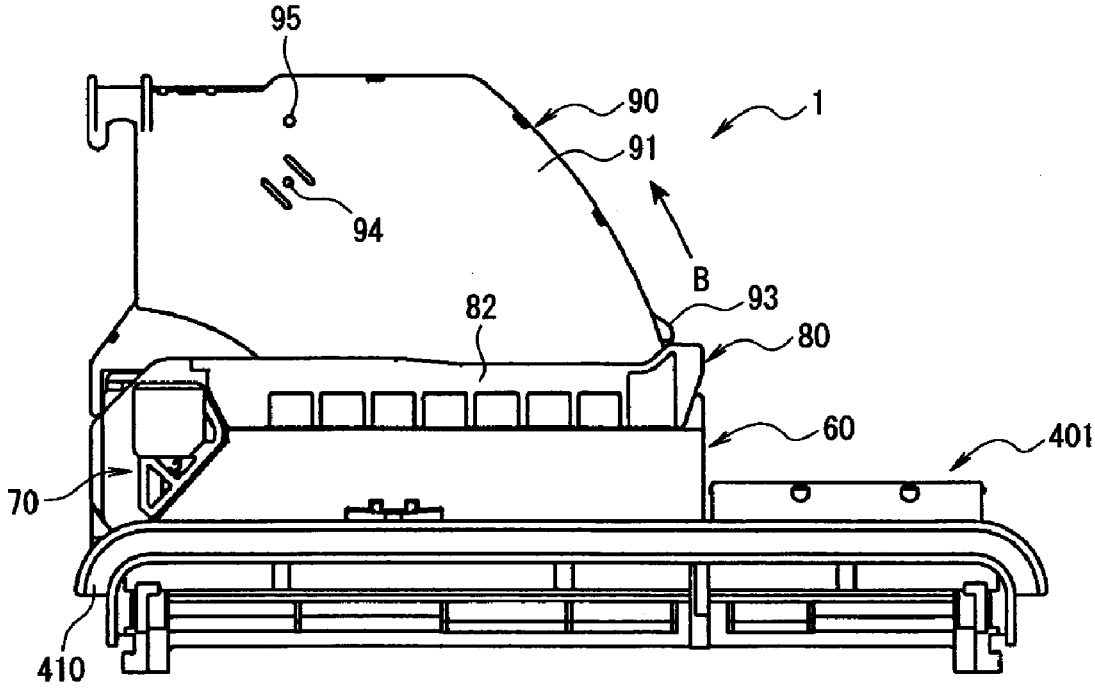
FIG. 9A and FIG. 9B are explanatory views illustrative of a state where the mating of the lever-type connector and the mating connector is completed.
Figure 9B:
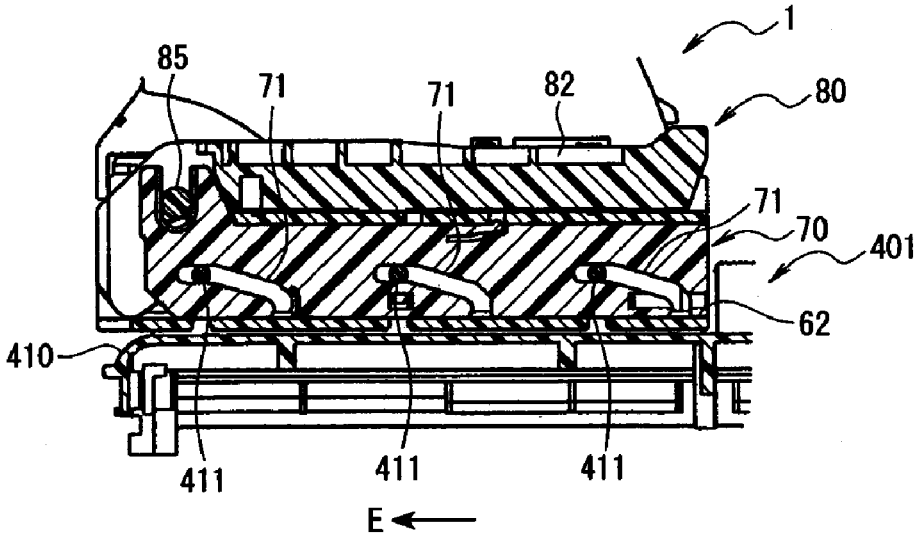
Figure 10:
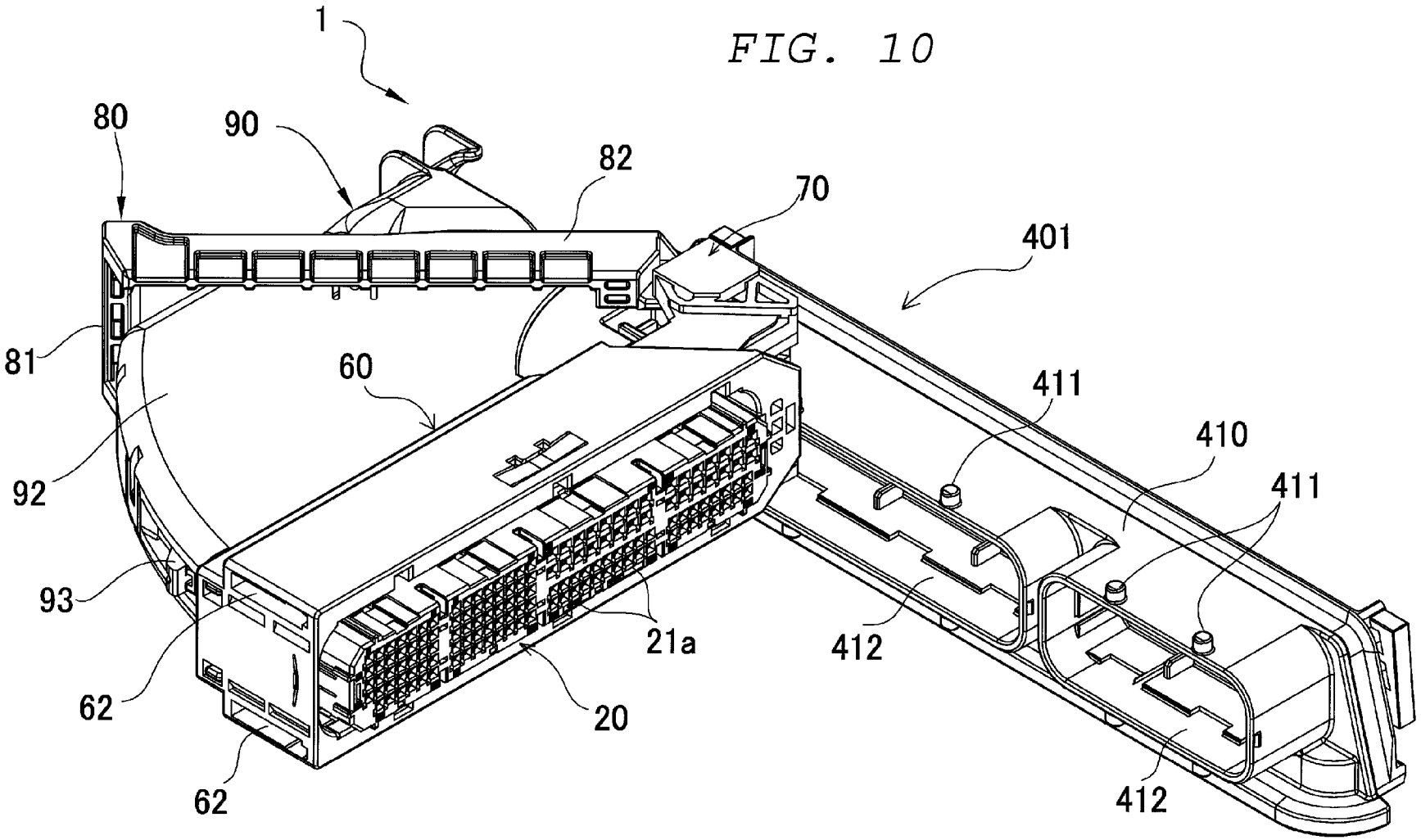
FIG. 10 is an explanatory view illustrative of a state where a mating connector is subject to so-called twist mating on the pivotal end of an arm of the lever.

Then, when the lever 80 is further rotated in the direction of arrow A to the mating position, the slider 70 slides in conjunction with the lever 80 in the direction of arrow D, namely the slider 70 further slides in the left direction as illustrated in FIG. 9A and FIG. 9B. In this process, the operation of the cam grooves 71 arranged at the slider 70 and the cam pins 411 arranged at the mating connector 401 causes the lever-type connector 1 and the mating connector 401 to come to the final positions. Accordingly, the mating operation of the lever-type connector 1 and the mating connector 401 is completed. When the lever 80 is located at the mating position, the rotation of the lever 80 in the direction of arrow B as illustrated in FIG. 10 is prevented by the lock 93.

Meanwhile, in order to separate the lever-type connector 1 from the mating connector 401, the lock 93 is firstly pushed so that the lever 80 can rotate. Next, the lever 80 at the mating position is rotated in the direction of arrow B as illustrated in FIG. 9A and FIG. 9B to be located at the separated position. When the lever 80 is rotated in the direction of arrow B, the slider 70 interlocks with the lever 80 and slides in the direction of arrow E, namely in the left direction, as illustrated in FIGS. 9A and 9B. This achieves the temporary locking state illustrated in FIG. 7A and FIG. 7B through the state where the lever-type connector 1 and the mating connector 401 are on the way of being mated as illustrated in FIG. 8A and FIG. 8B. In this process, the operation of the cam grooves 71 arranged at the slider 70 and the cam pins 411 arranged at the mating connector 401 causes the lever-type connector 1 and the mating connector 401 to move in a direction of being separated from each other.

Subsequently, when the mating connector 401 is pulled out in a direction opposite to the direction of arrow C illustrated in FIG. 6A and FIG. 6B, the lever-type connector 1 and the mating connector 401 are separated.

Here, in order to mate the lever-type connector 1 and the mating connector 401, when the lever 80 and the slider 70 are located at the separated positions as illustrated in FIG. 6A and FIG. 6B, the right end of the slider 70 protrudes from the right end of the outer housing 60, and the pivotal end of the arm 82 of the lever 80 also protrudes from the right end of the outer housing 60. In this state, as shown in FIG. 10, the mating connector 401 is obliquely mated, namely the mating connector 401 is subject to twist mating on the pivotal end of the arm 82 in the lever 80, in some cases.

Figure 11:
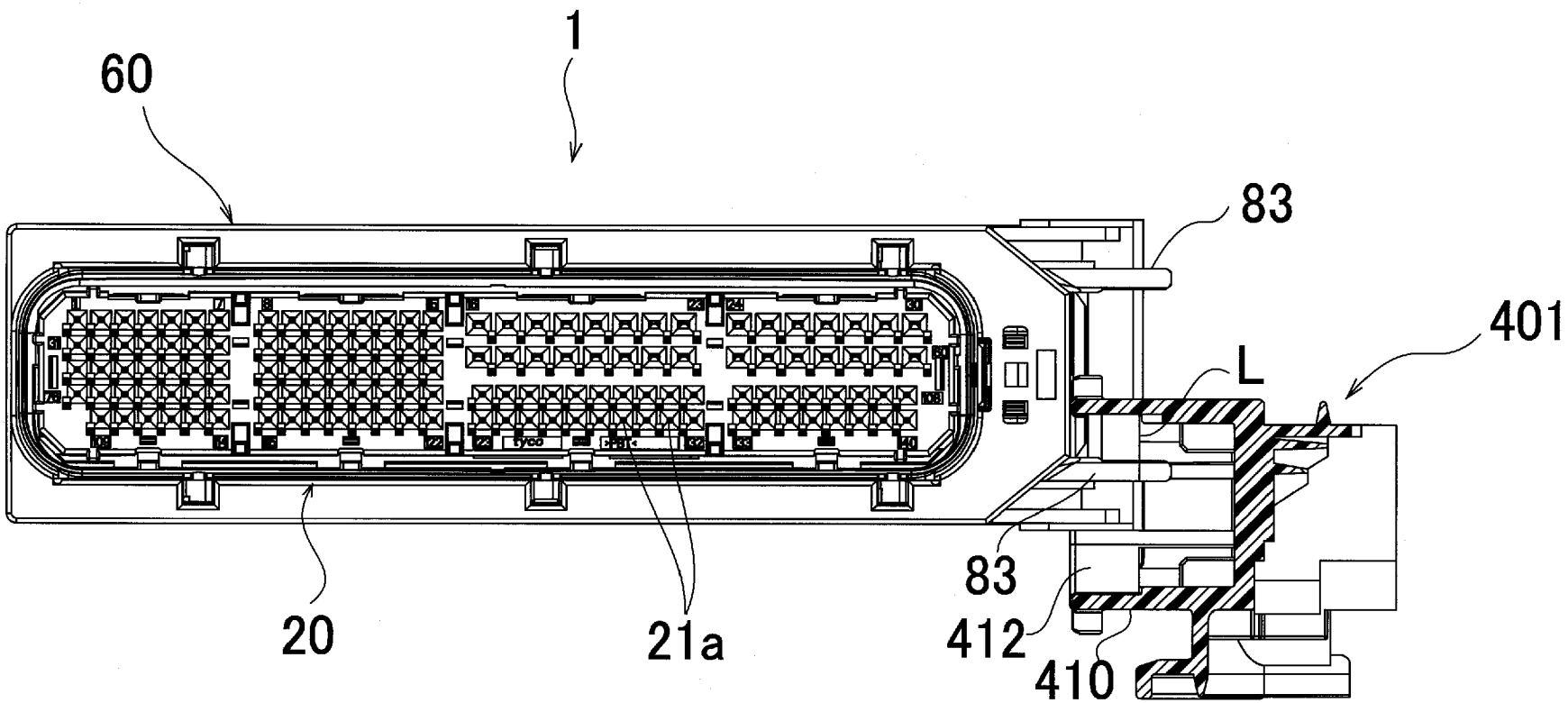
FIG. 11 is an explanatory view showing the mating connector is subject to so-called twist mating with the lever-type connector without the provision of a wall portion at the wall portion of the lever.

In this case, as shown in FIG. 11, without the provision of the wall portions 86*a* and 86*b* at the extensions 83 arranged on the pivotal end of the pair of the arms, respectively, as shown in FIG. 11, any of the extensions 83 on the pivotal end of the arms 82 will enter a mating part 412 of the housing 410 in the mating connector 401. If so, the extension 83 might come into contact with an end of the mating contact (In FIG. 11, L indicates a line of ends of the contacts) arranged at the mating connector 401 and damage the mating contact.

Figure 12:
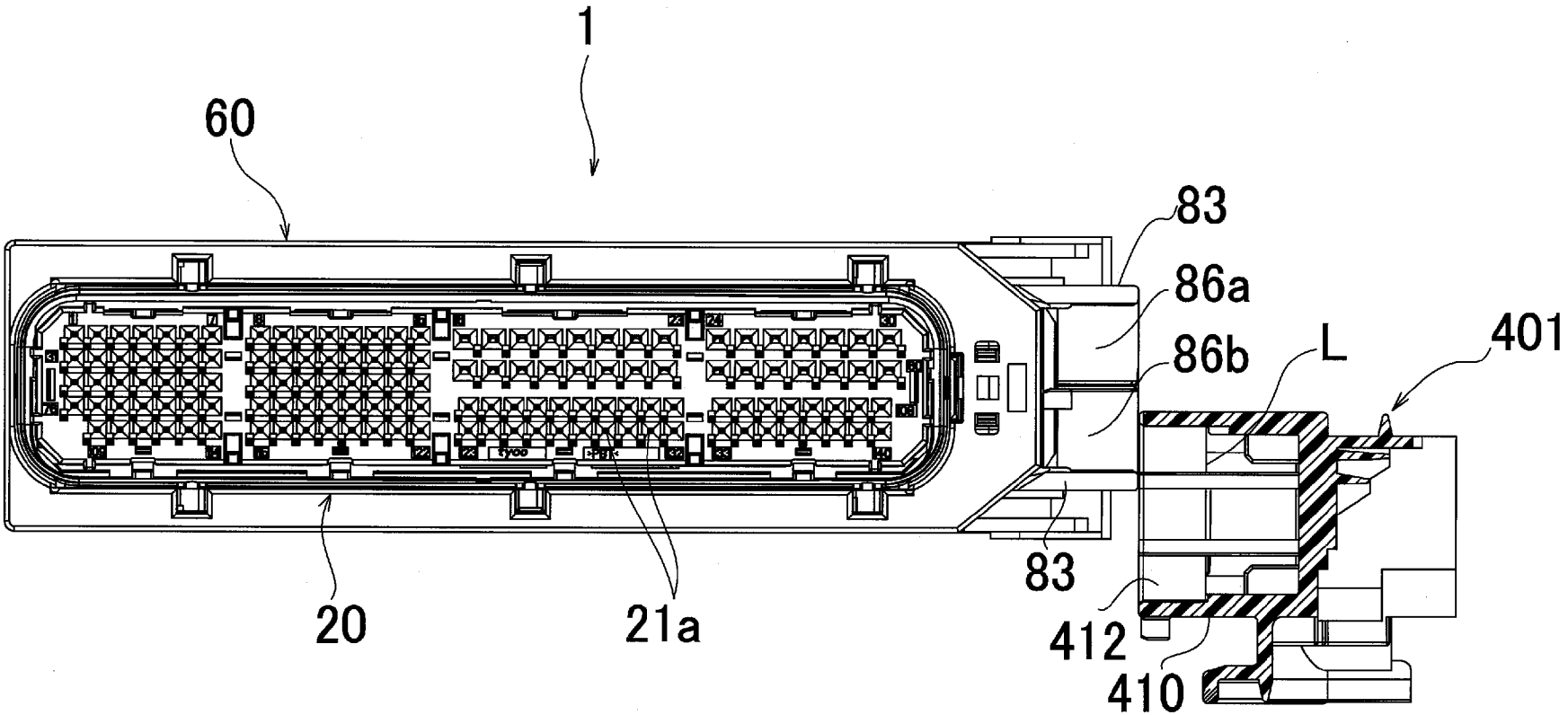
FIG. 12 is an explanatory view showing the mating connector is subject to so-called twist mating with the lever-type connector of FIG. 1 with the provision of a wall portion at the wall portion of the lever.
Figure 13:
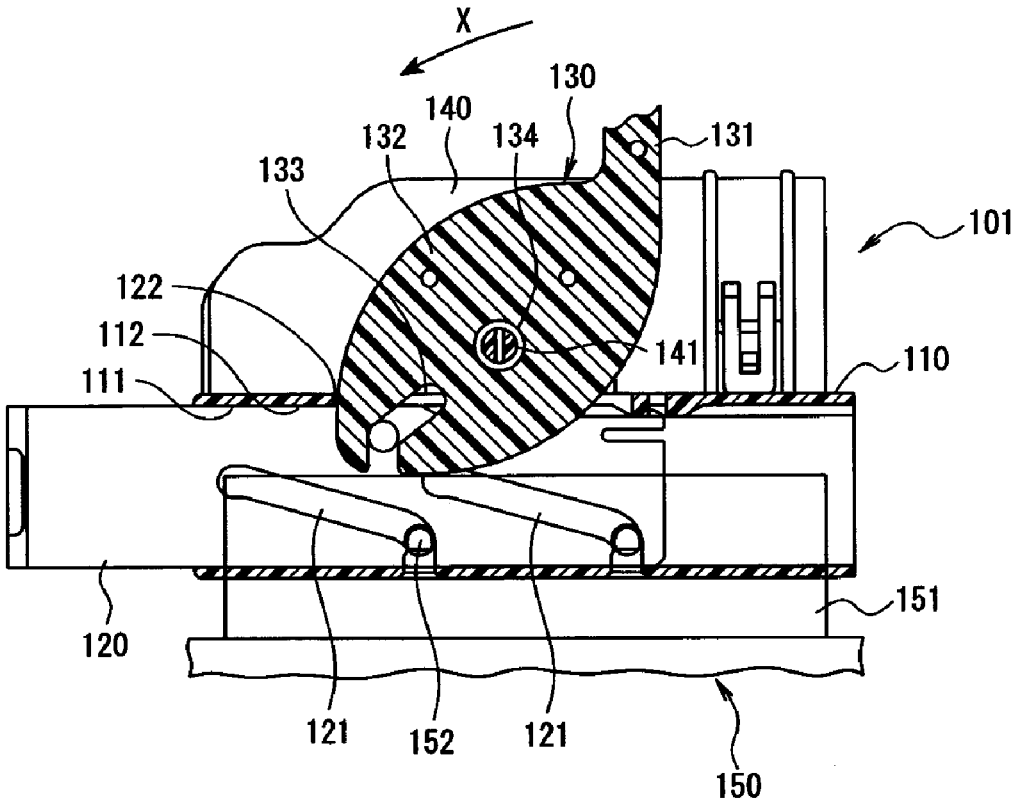
FIG. 13 is a cross-sectional view of a conventional lever-type connector.
Figure 14:
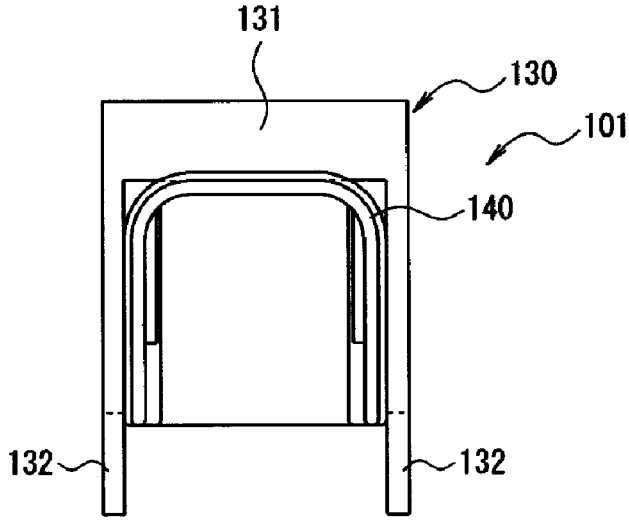
FIG. 14 is an explanatory view showing the wire cover and the lever of the lever-type connector shown in FIG. 13.

In contrast, in the present embodiment, with the wall portions 86*a* and 86*b* arranged at the extensions 83, respectively, on the pivotal end of the pair of the arms 82, the pair of the wall portions 86*a* and 86*b* are brought into contact with the housing 410 of the mating connector 401 to prevent any of the extensions 83 arranged at the pivotal end of the arms 82 from entering into the mating part 412 of the housing 410 in the mating connector 401 as shown in FIG. 12. This prevents any damage caused at the mating contacts provided in the mating connector 401.

Incidentally, the pair of the wall portions 86*a* and 86*b* extend from the extensions 83 on the pivotal end of the pair of the arms 82, respectively, so as to oppose to each other at the end edges 86*c* and 86*d*. The pair of the wall portions 86*a* and 86*b* are not integrally formed. For this reason, it is possible to separate the pair of the wall portions 86*a* and 86*b* from each other, and the lever 80 is not always closed in a circular manner. It is therefore possible to exchange the lever 80 with ease. Even if the connector 81, included in the lever 80, the pair of the arms 82, and the pair of the wall portions 86*a* and 86*b* are integrally formed and the lever 80 is always closed in a circular manner, and in addition, if the mating connector 401 is subject to so-called twisting mating on the pivotal end of the arm 82 of the lever 80, it is possible to avoid the damage caused at any mating contact arranged at the mating connector 401. However, if the lever 80 is always closed in a circular manner as described, the bundle W of the electrical wires together with the contacts has to be pulled out of the inner housing 10 once in order to remove the lever 80 from the outer housing 60 for exchange. This is because the bundle W of the electrical wires extracted from the outer housing 60 is extracted to the outside through the lever 80 closed in a circular manner. This makes it difficult to exchange the lever 80 with ease.

Also, as a measure against the twist mating of the mating connector 401 on the pivotal end of the arm 82 in the lever 80, the pair of the wall portions 86*a* and 86*b* arranged at the pivotal end of the pair of the arms 82 may be integrally formed, respectively, and the connector 81 may be bifurcated. However, in a case where the connector 81 has a divided structure, when the lever 80 is operated for rotation by pushing the connector 81, the shape of the connector 81 to be pushed is unstable. This will open and twist the lever 80. Accordingly, the pair of the wall portions 86*a* and 86*b* call for a divided structure instead of the connector 81.

In addition, in the lever-type connector 1, the wall portion 86*b*, which is one of the pair of the wall portions 86*a* and 86*b*, is provided with the projected portion 87 that projects toward the wall portion 86*a*, which is the other thereof. The end edge 86*c* of the wall portion 86*a*, which is the other of the pair of walls 86*a* and 86*b*, is provided with a groove 88 into which the projected portion 87 enters. The end edges 86*c* and 86*d* have a projected and depressed structure with the groove 88 into which the projected portion 87 enters. Accordingly, when the mating connector 401 is subject to so-called twist mating on the pivotal end of the arm 82 of the lever 80, and in addition, the housing 410 of the mating connector 401 pushes the pair of the wall portions 86*a* and 86*b*, the wall portions 86*a* and 86*b* will not open with ease, so the lever 80 will not be twisted. It is therefore possible to prevent any of the arms 82 on the pivotal end thereof from entering into the mating connector 401 with certainty.

Furthermore, in the lever-type connector 1, the width W2 of the outlet 96, for the bundle of the electrical wires, arranged at the wire cover 90 is set greater than the width (height) d in the upper-and-lower direction of the contact accommodating area in the outer housing 60, and at the same time, the wire cover 90 has a structure divided into two parts. Accordingly, the wire cover 90 including the lower side cover 91 and an upper side cover 92 is produced by forming the lower side cover 91 and an upper side cover 92 separately and then assembling them. This allows the production of the wire cover 90 in which the width W2 of the outlet 96, for the bundle of the electrical wires is set greater than the width (height) d in the upper-and-lower direction of the contact accommodating area in the outer housing 60, with ease. Since the width W2 of the outlet 96, for the bundle of the electrical wires, arranged at the wire cover 90 is greater than the width (height) d in the upper-and-lower direction of the contact accommodating area in the outer housing 60, the bundle W of the electrical wires can be extracted from the outlet 96, even if the diameters of multiple electrical wires extracted from the outer housing 60 are large and the diameter of the bundle W of the electrical wires is large.

Moreover, the wire cover 90 has a structure divided into two parts including the lower side cover 91 and the upper side cover 92, such that the lower side cover 91 and the upper side cover 92 (separated structure) are separately formed. This allows any shape of the outlet 96 defined by the lower side cover 91 and the upper side cover 92, namely any shapes of the lower and upper side flared portions 91*f* and 92*f*. The direction of extracting the bundle W of the electrical wires or the width of the outlet 96 can be varied by changing the shapes of the lower and upper side flared portions 91*f* and 92*f*.

While the embodiments of the present invention have been illustrated in detail, it should be apparent that modifications and adaptations to those embodiments may occur.

For example, the pair of the wall portions 86*a* and 86*b* are arranged at the pair of the extensions 83 at the end portions on the pivotal end of the pair of the arms 82. However, the pair of the wall portions 86*a* and 86*b* are not necessarily arranged at pair of the extensions 83. The pair of the wall portions 86*a* and 86*b* may be arranged at any place as far as they are arranged on the roots side of the pair of the arms 82.

In addition, the lever 80 is rotatably and detachably provided with respect to the outer housing 60. However, if the outer housing 60 is not provided, the lever 80 may be arranged at the inner housing 10 for accommodating the contacts.

Further, the lever 80 may be arranged at the wire cover 90, instead of the outer housing 60 or the inner housing 10.

Moreover, the upper side cover 92 and the lower side cover 91 both forming the wire cover 90 do not have a symmetrical structure. However, the upper side cover 92 and the lower side cover 91 may have a symmetrical structure. The upper side cover 92 and the lower side cover 91 may have different shapes from the illustrated ones.

What is claimed:

1. A lever-type connector comprising:

a housing;

at least one contact received in the housing;

a slider receiving slot formed in the housing;

a slider being slidably received in the slider receiving slot;

a wire cover being attached to the housing and having an outlet;

a bundle of electrical wires connected to each contact and extracted from the outlet;

a lever including a connector and provided being rotatably and detachably disposed on the housing and the cover to slide the slider;

a pair of arms that extend from both ends of the connector, the lever being attached to the housing and the cover on a pivotal end of the arms;

a pair of wall portions arranged at the pivotal end of the arms of the lever;

a projection portion arranged along an edge of one of the wall portions and projecting toward the other of the wall portions; and a groove located along an end edge of the other of the wall portions into which the projected portion enters;

wherein the wall portions extend from the pivotal end of the arms, respectively, and oppose each other at end edges of the wall portions, respectively.

2. A lever-type connector according to claim 1, wherein a width of the outlet arranged at the wire cover is greater than a width of the contact receiving area in the housing.

3. The lever-type connector according to claim 2, wherein the two parts of the cover include a lower side cover and an upper side cover attached to the lower side cover.

4. The lever-type connector according to claim 3, further comprising lower side latches on the lower side cover and upper side latches on the upper side cover, the lower side latches locking with the upper side latches to complete the wire cover.

5. The lever-type connector according to claim 4, wherein the wire cover attaches to a rear side of the housing.

6. The lever-type connector according to claim 4, further comprising a lower side flared portion of the lower side cover and an upper side flared portion of the upper side cover, wherein the outlet is arranged therebetween.

7. A lever-type connector comprising:

a housing;

a contact receiving area provided in the housing receiving at least one contact;

a slider receiving slot formed in the housing;

a slider being slidably received in the slider receiving slot;

a wire cover attached to the housing, the cover having an outlet divided into two parts;

a bundle of electrical wires connected to each contact and extracted from the outlet;

a lever including a connector and being rotatably and detachably disposed on the housing and the cover to slide the slider;

a pair of arms that extend from both ends of the connector, the lever being attached to the housing and the cover on a pivotal end of the arms;

a pair of wall portions arranged at the pivotal end of the arms of the lever;

a projection portion arranged along an end edge of one of the wall portions, the projection portion projecting toward the other of the wall portions; and a groove disposed along an end edge of the other of the wall portions into which the projection portion enters;

wherein the wall portions extend from the pivotal end of the arms, respectively, and oppose each other at end edges of the wall portions, respectively; and wherein a width of the outlet arranged at the wire cover is greater than a width of the contact receiving area in the housing.

8. The lever-type connector according to claim 7, wherein the two parts of the cover include a lower side cover and an upper side cover attached to the lower side cover.

9. The lever-type connector according to claim 8, further comprising lower side latches on the lower side cover and upper side latches on the upper side cover, the lower side latches locking with the upper side latches to complete the wire cover.

10. The lever-type connector according to claim 9, further comprising a lower side flared portion of the lower side cover and an upper side flared portion of the upper side cover, wherein the outlet is arranged therebetween.

* * * * *